United States Patent [19]

Cantley

[11] Patent Number: 4,808,974

[45] Date of Patent: Feb. 28, 1989

[54] DOOR ALARM

[76] Inventor: Richard E. Cantley, 1469 Shelley St., NE., North Canton, Ohio 44721

[21] Appl. No.: 68,328

[22] Filed: Jul. 1, 1987

[51] Int. Cl.[4] ..... G08B 13/08

[52] U.S. Cl. ..... 340/546; 200/61.62; 200/61.93

[58] Field of Search ..... 340/545, 546, 541, 693; 200/61.62, 61.64, 61.93

[56] References Cited

U.S. PATENT DOCUMENTS

| | | | |
|---|---|---|---|
| 3,261,010 | 7/1966 | Kardel | 340/546 |
| 3,878,539 | 4/1975 | Gooding | 340/546 |
| 4,176,347 | 11/1979 | McIntyre | 340/545 |
| 4,222,042 | 9/1980 | Cantley | 340/546 |
| 4,258,359 | 3/1981 | McLamb | 340/546 |
| 4,438,428 | 3/1984 | Ober et al. | 340/546 X |
| 4,439,758 | 3/1984 | Cantley | 340/546 |
| 4,484,181 | 11/1984 | Schwartz | 340/546 X |

*Primary Examiner*—Glen R. Swann, III

*Attorney, Agent, or Firm*—Michael Sand Co

[57] ABSTRACT

A portable security device adapted to be removably mounted on the top edge of an inwardly swinging door whereby opening of the door will automatically actuate a battery-operated alarm. The alarm includes an audible buzzer, the battery, a manual set switch, an actuation lever and associated wiring electrically connecting said components. The actuation lever is formed of spring steel and projects outwardly from a housing containing the alarm components and is biased to the alarm ON position. The lever is moved to the alarm OFF position by contact with the door frame when the door is in the closed position. Upon inward movement of the door by an intruder the lever is urged by its bias to the alarm ON position thereby actuating the alarm. A lock-in circuit may be incorporated into the main electrical circuitry of the alarm to prevent deactivation of the alarm even if the actuation lever or the set switch is moved to the alarm OFF position.

9 Claims, 2 Drawing Sheets

DOOR ALARM

TECHNICAL FIELD

The invention relates to security devices and in particular to door alarms for doorways and more particularly to a portable device adapted to be removably mounted on the top of a door, which device contains an alarm that is actuated when an unauthorized opening of the door is attempted.

BACKGROUND ART

The use of security devices on doorways of dwellings and businesses has been prompted by high crime rates in many areas and the resultant desire of people to protect themselves and their property from such peril. However, many of the prior art security devices require permanent mounting of the device or components thereof on the door or doorframe, or both, which imparts a cluttered, unsightly appearance to the door and which requires holes to be drilled into the door or doorframe. Also, such devices are usually in addition to the existing door lock.

Numerous security devices also have been devised and constructed over the years for removably mounting on a door or adjacent thereto for sounding an alarm when the door is opened to protect the occupants of a dwelling. Many of these prior devices appear to provide a satisfactory alarm and are suitable for their intended purpose. However, many of these prior alarms do not remain activated if the door is immediately closed by an intruder once the alarm is initially sounded, or in the alternative, if the intruder deactivates the alarm by actuating an ON/OFF switch.

Many prior art alarms are designed for specific door types and constructions and provide no flexibility to the user. It is also desirable that the user be able to carry the alarm in luggage and adapt it for use when at a motel or hotel without requiring a permanent attachment to the door and which will not mar the door, yet provide the desired security to the guest from possible intruders since the instances of intruders in motels and hotels from previously obtained keys has increased in recent years.

There is no security device of which I am aware which achieves the desired alarm feature in a cost effective manner while providing a door alarm which may be temporarily mounted on doors in a quick, efficient manner without marring the door, and which is small and lightweight enabling it to be carried in a handbag or suitcase while traveling for use in hotel or motel rooms.

DISCLOSURE OF THE INVENTION

Objectives of the invention include providing a security device which may be removably mounted on doors of differing thicknesses and configurations and which will not mar the doorframe or door when mounted thereon.

Another objective is to provide such an improved security device which is inexpensive, lightweight and small enough to be carried in a suitcase or handbag when traveling to provide protection when at motels, hotels, etc.

A still further objective of the invention is to provide a security device which has an audible alarm which is activated immediately upon opening of the door on which it is placed to warn the occupant of the room and deter the entrance of the intruder.

Another objective of the invention is to provide such an improved security device in which the alarm, once activated, cannot be deactivated by usual means such as turning a switch to the alarm OFF position, and in which a lock in control circuit may be incorporated into the electrical circuitry of the alarm to achieve such results.

Still another objective of the invention is to provide such an improved security device in which the alarm is contained within a housing that is removably mounted on an adjustable door-mounting bracket for ease of repair of the alarm or replacement of the battery of the alarm.

A further object of the invention is to provide such an improved security device which can be constructed of usual, readily available components requiring a standard nine volt battery for the power supply for the alarm, which can be used with a door having a usual security door chain since the alarm is activated as soon as the door starts toward the open position whereby the alarm will sound even before the door has reached a partially opened position thereby providing a warning to the occupant of a possible intruder while retaining the security of the door chain.

Another object is to provide such a security device which is actuated by a single spring steel strip which is relatively maintenance free and which will not lose its bias effectiveness over extended periods of time and use; in which the housing and mounting brackets of the device have protective pads mounted thereon to prevent marring of the door and doorframe; and in which the use of the device on a door is relatively unnoticeable by a possible intruder thereby minimizing the likelihood of the intruder trying to circumvent the alarm by gaining access into the dwelling by a different route.

Another objective of the invention is to provide such an improved security device in which the alarm components are contained within a housing preferably formed of plastic, and are relatively unaffected by a jarring or movement of the alarm during travel; and in which the housing can be formed in various colors during injection molding thereof to match the color of the door if used in an established residence thereby reducing its appearance when mounted on the door and which provides an extremely simple and inexpensive device yet highly effective in its operation for achieving its intended purpose.

These objectives and advantages are achieved by the improved security device of the invention which is adapted to be removably mounted on the top edge of an inwardly swinging door; the general nature of which may be stated as including a housing; alarm means located within the housing having an actuation lever projecting outwardly beyond the housing, said lever being movable between alarm ON and OFF positions and biased toward the alarm ON position, said lever being biased toward engagement with an inside frame of a door when the security device is mounted on the door; and bracket means for mounting the housing on the door, whereby the actuation lever will engage the inside frame of the door which moves said lever to the alarm OFF position when the door is closed, and in which said lever will move to the alarm ON position upon inward movement of the door to actuate the alarm.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
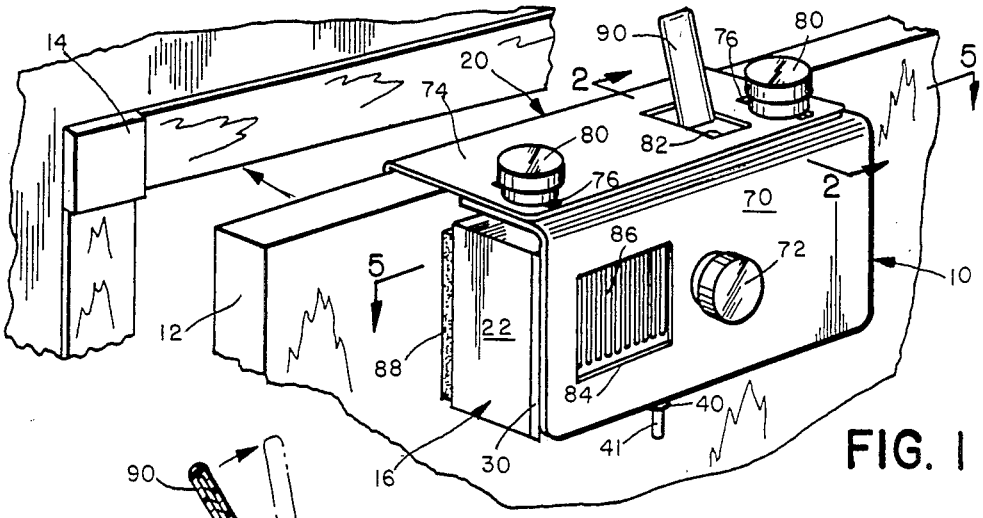
FIG. 1 is a fragmentary perspective view showing the improved security device mounted on a door.

The improved security device of the present invention is indicated generally at 10, and is shown particularly in FIG. 1 mounted on the top edge of a usual inwardly swinging door 12 which is shown in a partial open position with respect to a door frame 14. Security device 10 consists of a box-shaped housing indicated generally at 16, containing an audible alarm indicated generally at 18; and an adjustable mounting bracket indicated generally at 20.

Figure 2:
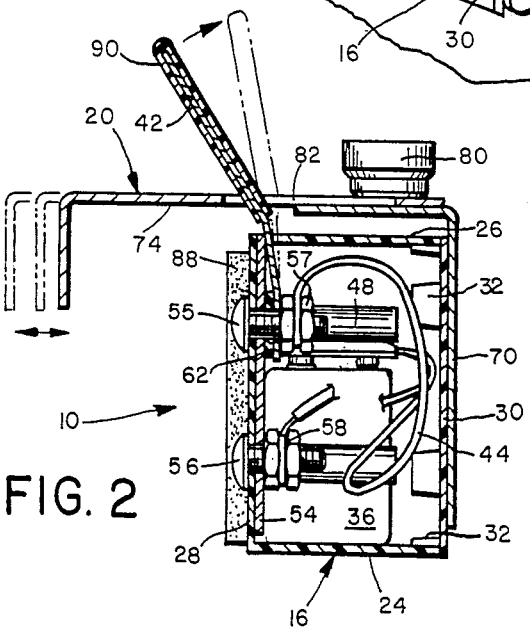
FIG. 2 is an enlarged sectional view taken on line 2—2, FIG. 1, with the movement of the actuation lever and adjustability of the mounting bracket being shown in dot dash lines.

Housing 16 is hollow and has a generally rectangular configuration defined by a pair of spaced parallel side walls 22, a bottom wall 24, a top wall 26, and a rear wall 28, preferably formed as an integral one-piece member. A front wall 30 having a plurality of flanges 32 is removably mounted on the one piece housing member by a snap fit engagement of flanges 32 with walls 22, 24 and 26 (FIG. 2).

Alarm 18 includes a battery 36, an audible buzzer 38 which is energized by battery 36, a set switch 40 which is manually actuated by a plunger 41 for electrically connecting and disconnecting buzzer 38 to battery 36 and an actuation lever 42. All of these components are electrically connected by a usual electrical circuit comprising a plurality of conductors 44.

Figure 4:
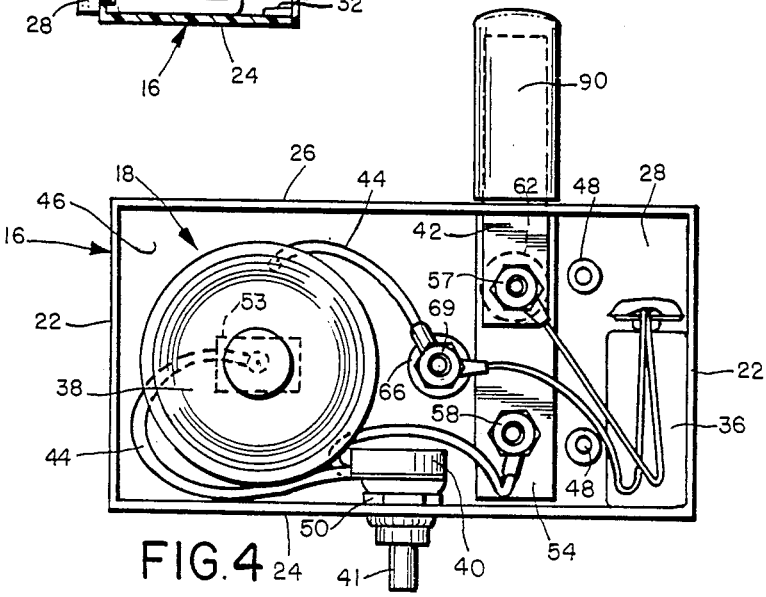
FIG. 4 is a front elevational view of the security device with the front wall of the housing and mounting bracket removed.

All of the components of alarm 18 are mounted within hollow interior 46 of housing 16. Battery 36 preferably is located in an area defined by bottom wall 24, rear wall 28, top wall 26, a side wall 22 and two cylindrical projections 48 which are integral with and perpendicular to rear wall 28 and which extend a substantial distance outward from rear wall 28 in the direction of front wall 30. Switch 40 is mounted on bottom wall 24 of housing 16 by a pair of nuts 50 (FIG. 4) and plunger 41 which actuates switch 40 projects therefrom perpendicular to and through an opening in bottom wall 24. Buzzer 38 is secured to rear wall 28 by bolt 52 which passes through an opening in rear wall 28 and through a threaded bracket 53 which is integral with buzzer 38. A conductive strip 54, which spans the entire height of rear wall 28, is mounted thereon by bolts 55 and 56 which are secured to rear wall 28 by nuts 57 and 58, respectively.

Figure 7:
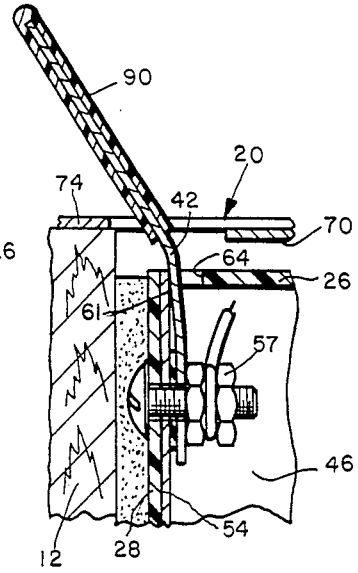
FIG. 7 is an enlarged fragmentary sectional view similar to FIG. 6 showing the actuation lever in its biased alarm ON position.

Actuation lever 42, a spring steel strip which is biased to the alarm ON position, is mounted by one of its terminal ends to the interior of housing 16 by bolt 55 which passes through openings in rear wall 28 and conductive strip 54. A washer 62, which is made of a dielectric material such as plastic or the like, is mounted on bolt 55 and is located between the inner terminal end of actuation lever 42 and conductive strip 54 to electrically separate the lever from the strip. Nuts 57 securely clamp actuation lever 42 against washer 62, conductive strip 54 and rear wall 28. Similarly, bolt 56 passes through openings in rear wall 28 and conductive strip 54, with conductive strip 54 being further secured against rear wall 28 by nuts 58. Actuation lever 42 projects upwardly through an opening 64 in top wall 26 and outwardly therefrom, being biased to the alarm ON position as shown particularly in FIGS. 2 and 7.

Figure 5:
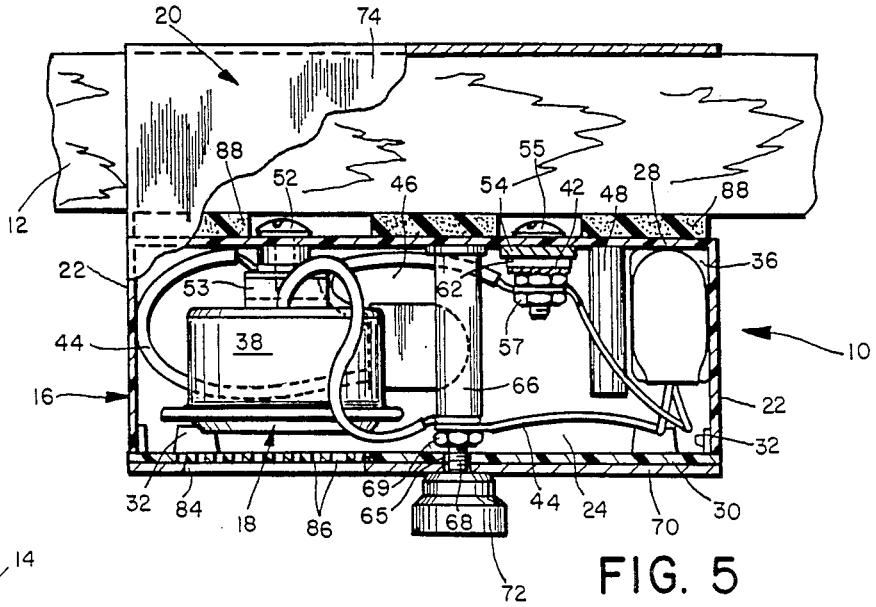
FIG. 5 is an enlarged fragmentary sectional view taken on line 5—5, FIG. 1.
Figure 6:
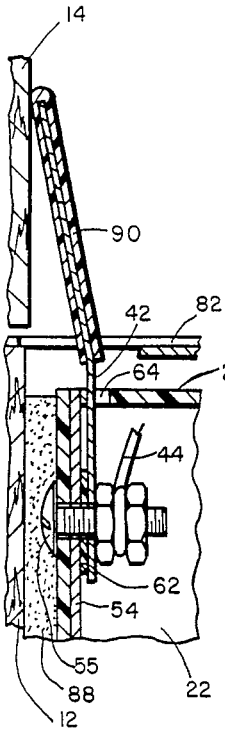
FIG. 6 is an enlarged fragmentary sectional view showing the actuation lever engaged with a doorframe placing the alarm in the OFF position.

A cylindrical post 66 is formed integral with rear wall 28 and extends perpendicularly therefrom and terminates adjacent the inside surface of front wall 30 and encases a bolt 68 (FIG. 5). A nut 69 engages bolt 68 and assists in connecting one of the electrical conductors 44 thereto. Bolt 68 projects outwardly beyond the end of post 66 and through an opening 65 in front wall 30. Bolt 68 is further adapted to pass through an opening in an inner plate 70 of mounting bracket 20. A cap nut 72 engages the terminal end of bolt 68 thereby securing housing 16 and the alarm contained therein to mounting bracket 20.

Figure 3:
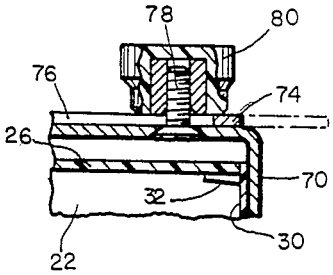
FIG. 3 is a fragmentary sectional view of the upper right hand portion of FIG. 2.

An outer plate 74 of mounting bracket 20 has a pair of spaced rectangular openings 76 located about a pair of bolts 78 (FIG. 3) integral with and projecting upwardly from the upper portion of inner plate 70. This arrangement enables outer plate 74 to be movable along the length of rectangular openings 76 so that mounting bracket 20 may be adjusted to a variety of door thicknesses as shown particularly in FIGS. 2 and 3. Outer plate 74 is securely clamped against inner plate 70 by a pair of cap nuts 80 which engage bolts 78. Additionally, outer plate 74 has a rectangular opening 82 through which actuation lever 42 passes allowing for its free movement between the alarm ON and OFF positions, as shown particularly in FIGS. 1, 2, 6 and 7. Further, inner plate 70 has a rectangular opening 84 (FIGS. 1 and 5) which juxtaposes a plurality of spaced vertical, rectangular openings 86 in front wall 30 allowing for passage of the audible alarm sound from within the housing.

FIG. 1 shows the placement of the security device 10 on the top edge of an inwardly swinging door 12 with outer plate 74 of mounting bracket 20 engaging the outside surface and top edge of door 12. Rear wall 28 of housing 16 abuts the inside surface of door 12, thereby holding security device 10 firmly in place. When door 12 is in the closed position, door frame 14 forces actuation lever 42 to the alarm OFF position, as shown particularly in FIGS. 2 and 6. When in this position, actuation lever 42 is separated from conductive strip 54 by plastic washer 62 thereby opening the electrical circuit which connects the buzzer to the battery so that buzzer 38 will not produce an audible sound.

As door 12 swings inwardly, actuation lever 42 is urged by its bias to the alarm ON position so that it contacts conductive strip 54 at a location 61 (FIG. 7) thereby completing the electrical circuit actuating buzzer 38 and emitting a loud audible noise, provided that switch 40 has been previously actuated to the alarm ON position. Audible buzzer 38 is designed to warn the occupants of a dwelling of the unauthorized entrance of an intruder, or in the alternative, to scare the intruder away.

Alarm 34 may include a lock-in circuit 92 (FIG. 8) as a part of the main electrical circuitry of the alarm. Lock-in circuit 92 which is well known in the art, prevents deactivation of buzzer 38 by either moving actuation lever 42 to the alarm OFF position or by actuating switch 40 to the alarm OFF position once the buzzer has been activated by an intruder. Disconnecting battery 36 from electrical circuit 44 is the only way to deactivate audible buzzer 38 once it is activated, thereby making it difficult for an intruder to deactivate the security device 10 before he is discovered or before he is scared away by the sound of buzzer 38.

Three rectangular pads 88 made of sponge rubber or the like are adhesively attached to rear wall 28 of housing 16 to provide protection to the inside surface of door 12 against marring from the heads of bolts 52, 55 and 56, which protrude from rear wall 28. Additionally, actuator lever 42 is covered with a protective sheath 90 made of rubber, vinyl or the like which protects door frame 14.

Figure 8:
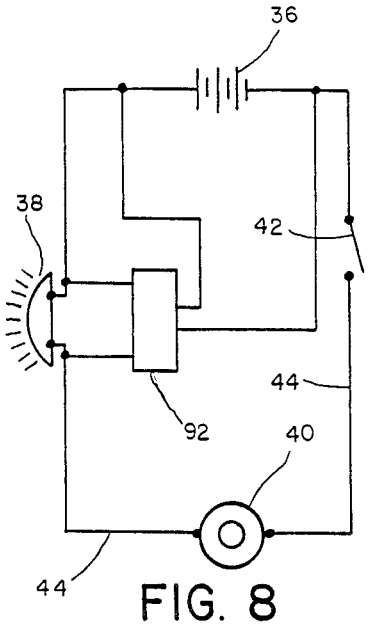
FIG. 8 is a schematic diagram of the electrical wiring of the security device.

At the time of placement of security device 10 on door 12, the user of the security device must turn set switch 40 to its ON position by manual actuation of plunger 41 whereby electrical circuit 44 is closed at that location whereby buzzer 38 will be connected to battery 36 upon movement of actuation lever 42 to its closed or alarm ON position upon inward movement of door 12, as described in detail above (FIG. 8).

Accordingly, the improved security device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved security device is constructed and used, the characteristics of the construction, and the advantageous, new and useful results obtained; the new and useful structures, devices, elements, arrangements, parts, and combinations, are set forth in the appended claims.

What is claimed is:

1. An improved security device adapted to be mounted on the top edge of an inwardly swinging door, said device including:

(a) a housing having a hollow interior;

(b) bracket means for mounting the housing on the door;

(c) alarm means mounted within the hollow interior of the housing, said alarm means including an actuation lever projecting outwardly beyond the housing, a battery, an audible buzzer operable by the battery, a set switch operable by a manually activated plunger for opening and closing an electric circuit between the buzzer and said battery through the actuation lever, and a plurality of conductors electrically connecting said buzzer to the battery, set switch and actuation lever, said lever including a spring steel strip, one end of which is attached within the housing to a strip of conductive material, said one end being separated from said conductive strip by dielectric material, said spring steel strip being movable between alarm ON and OFF positions and biased toward the alarm ON position, said spring steel strip further being biased toward engagement with an inside frame of a door when the security device is mounted on the door, wherein an opposite end of the spring steel strip which projects outwardly from the housing engages the inside frame of the door for moving said spring steel strip to the alarm OFF position when the door is closed, said spring steel strip moving to the alarm ON position upon inward movement of the door, so that an electrical circuit is completed between the battery and buzzer when said opposite end of the spring steel strip is urged by its bias upon inward movement of the door to the alarm ON position causing said one end of the spring steel strip to contact the strip of conductive material to complete said circuit to actuate the buzzer.

2. The device defined in claim 1 in which the housing has a hollow, generally rectangular configuration defined by a pair of spaced parallel side walls, a bottom wall, spaced parallel front and rear walls, and a top wall.

3. The device defined in claim 2 in which the housing side, bottom, rear and top walls are formed as an integral one-piece member, and in which the front wall is removably mounted on said one-piece member.

4. The device defined in claim 2 in which a protective pad is attached to the exterior of the rear wall of the housing and is engageable with the door to prevent marring of the door by said housing.

5. The device defined in claim 1 in which the mounting bracket means includes an inner "L"-shaped plate attached to the front wall of the housing and an outer "L"-shaped plate adjustably mounted on said inner plate and engageable with the top edge of the door.

6. The device defined in claim 5 in which the outer plate of the mounting bracket means is formed with an opening through which the outwardly projecting actuation lever passes to permit movement of said lever between the alarm ON and OFF positions.

7. The device defined in claim 6 in which the alarm means includes a buzzer which generates an audible noise; in which the front wall of the housing is formed with an opening whereby the alarm noise will pass readily from within the housing.

8. The device defined in claim 7 in which the inner plate of the mounting bracket means includes an opening which juxtaposes the opening in the front wall of the housing.

9. The device defined in claim 1 in which a protective sheath is mounted on an extended end of the actuation lever which engages the inside frame of the door to protect said door frame.

* * * * *